US005577671A

United States Patent [19]

Seppänen et al.

[11] Patent Number: 5,577,671

[45] Date of Patent: Nov. 26, 1996

[54] METHOD FOR MANUFACTURING LOW BARK CONTENT WOOD CHIPS FROM WHOLE-TREE CHIPS

[75] Inventors: Veli Seppänen, Jyväskylä ; Kari Edelmann, Palokka, both of Finland

[73] Assignee: Valtion teknillinen tutkimuskeskus, Jyvaskyla, Finland

[21] Appl. No.: 347,462

[22] PCT Filed: Jun. 8, 1993

[86] PCT No.: PCT/FI93/00247

§ 371 Date: Dec. 6, 1994

§ 102(e) Date: Dec. 6, 1994

[87] PCT Pub. No.: WO93/25324

PCT Pub. Date: Dec. 23, 1993

[30] Foreign Application Priority Data

Jun. 8, 1992 [FI] Finland ..... 922636

[51] Int. Cl.[6] ..... B02C 9/04; B02C 23/12

[52] U.S. Cl. ..... 241/14; 241/28

[58] Field of Search ..... 209/580, 581, 209/582, 588; 241/14, 24, 28

[56] References Cited

U.S. PATENT DOCUMENTS

| | | | |
|---|---|---|---|
| 3,070,318 | 12/1962 | Blanchard | 241/14 |
| 3,254,847 | 6/1966 | Brandts et al. | 241/24 |
| 3,337,139 | 8/1967 | Lloyd et al. | 241/28 X |
| 3,826,433 | 7/1974 | Erickson et al. | 241/14 |
| 4,266,675 | 5/1981 | Barwise . | |
| 4,332,353 | 6/1982 | Lario . | |
| 4,992,949 | 2/1991 | Arden | 209/582 X |
| 5,335,790 | 8/1994 | Geiger et al. | 209/581 |

FOREIGN PATENT DOCUMENTS

| | | |
|---|---|---|
| 1215-762-A | 3/1986 | U.S.S.R. . |
| 1251-970-A | 8/1986 | U.S.S.R. . |

*Primary Examiner*—Timothy V. Eley
*Attorney, Agent, or Firm*—Jones & Askew

[57] ABSTRACT

A method for manufacturing low bark-content wood chips from whole-tree chips. The method has two or more sequential separation stages, which can be divided into pre-separation with a bark content of less than 10% and final cleaning, and in which the pre-separation comprises at least pneumatic separation and the final cleaning includes sorting based on color difference. Before pneumatic separation the bark is removed from the chips by grinding, which simultaneously reduces the particle size of the bark.

7 Claims, 3 Drawing Sheets

METHOD FOR MANUFACTURING LOW BARK CONTENT WOOD CHIPS FROM WHOLE-TREE CHIPS

FIELD OF THE INVENTION

The object of the invention is a method for manufacturing low bark content wood chips from whole-tree chips, in which method there are two or more sequential separation stages, which can be divided into pre-separation leading to a bark content of less than 10% and a final cleaning, and in which the pre-separation includes at least pneumatic separation as well as fines sieving and the final cleaning includes sorting based on colour separation or generally speaking on optical separation. In particular the invention is directed towards a cleaning method for birch and pine whole-tree chips.

BACKGROUND OF THE INVENTION

In present timber harvesting methods a considerable amount of the timber mass, in this case timber fibre biomass, is left in the forest, because it is unprofitable to collect it. When industry in Finland uses annually about 50 million $m^3$ of stemwood with bark, about 23 million $m^3$ of felling waste remains in the forest, of which it is estimated that half could be brought to the mill by using new harvesting technology.

Up until now cellulose has been manufactured from stemwood with bark, from which the bark can easily be removed by means of drum debarking. The exploitation of waste remaining in the forest cannot economically be connected to this chain.

So far it has not proved possible to use the mass obtained from forest waste, i.e. from crushed small trees and branches, in the manufacture of cellulose, because after even modern cleaning methods the bark content of the mass has been too great. Fines sieving achieves a bark content of only about 10%. It is true that patent publications U.S. Pat. No. 4,266,675, CH 643 160, SU 756 460, and SU 531 230 present various kinds of particle and even chip mass separators which operate on the principle of recognizing the differences in colour of the particles, in this case of the chips. These do not always give satisfactory results in the sorting of whole-tree woodchips with yield staying low and the remaining bark content staying high. It is not possible to achieve both a good yield and a high degree of cleanliness by purely adjusting the selection criteria of the separator.

Because timber mass used for cellulose has a considerably higher value than that used as fuel, there has been a obvious attempt to find a suitable cleaning method, by means of which chips suitable for cellulose manufacture with a bark content of less than 1% and a high yield can be obtained from whole-tree, i.e. forest chips.

SUMMARY OF THE INVENTION

The intention of this invention is to create a new kind of method, by means of which the above aims can be achieved. From the point of view of separation in accordance with the invention it is essential that the forest chips are first treated by grinding in order to remove the bark and by means of a good pre-separation method before colour difference sorting, because this is not able to remove a high bark content from the mass. At this stage pneumatic separation is essential, because light and thin particles, such as birch bark, cannot be separated in any other way and are a great inconvenience in later separation processes and especially in cellulose manufacture. Grinding creates internal cracks in the chips, in which case chemicals are absorbed more rapidly during cellulose cooking. Grinding is carried out alternatively either by a large-tolerance grinder or a vibrator cone crusher. At the present moment the former appears the better of the two.

In addition to bark colour difference separation, separators based on the shape and density of chips can be advantageously used, by means of which knot pieces among others can be removed.

BRIEF DESCRIPTION OF DRAWINGS

In what follows the invention is illustrated with the aid of the accompanying figures in which.

DETAILED DESCRIPTION OF PREFERRED EMBODIMENT

The following is a table illustrating the grinding of whole-tree chips.

| | Pine whole-tree chips | |
|---|---|---|
| | Original p-% | Ground p-% |
| Branches with bark | 5,4 | 2,3 |
| Loose bark | 10,0 | 11,7 |
| Chips with bark | 15,1 | 2,0 |
| Debarked chips | 59,0 | 60,7 |
| Fines | 10,7 | 23,3 |

In this example pine whole-tree chips are ground in a plate grinder with a blade gap of 7 mm. As can be seen from the above table, the share of knots and chips with bark in whole-tree chips treated by grinding is reduced considerably. It is true that the share of bark-free chips has not increased by a great deal, but this was due to the fact that at the beginning the chip size was at an acceptable level and during grinding the chip size was partly reduced to less than the acceptable level. Because of this it is advantageous to select a chip size for the whole-tree chips being treated that is too great, because the grinding nonetheless reduces the chip size. In that case there would be an obvious increase in the share of debarked chips.

Depending on the mill, different sizes of chips are used, being in general 6–8 mm. The share of chips that are too thick is seen in the share that remains in the sieve. This can be reduced considerably, because in grinding the chip thickness is reduced to an acceptable level. The thickness of the chips can be adjusted by setting the blade gap of the grinder as desired, advantageously to the zone 6–14 mm.

Figure 1:
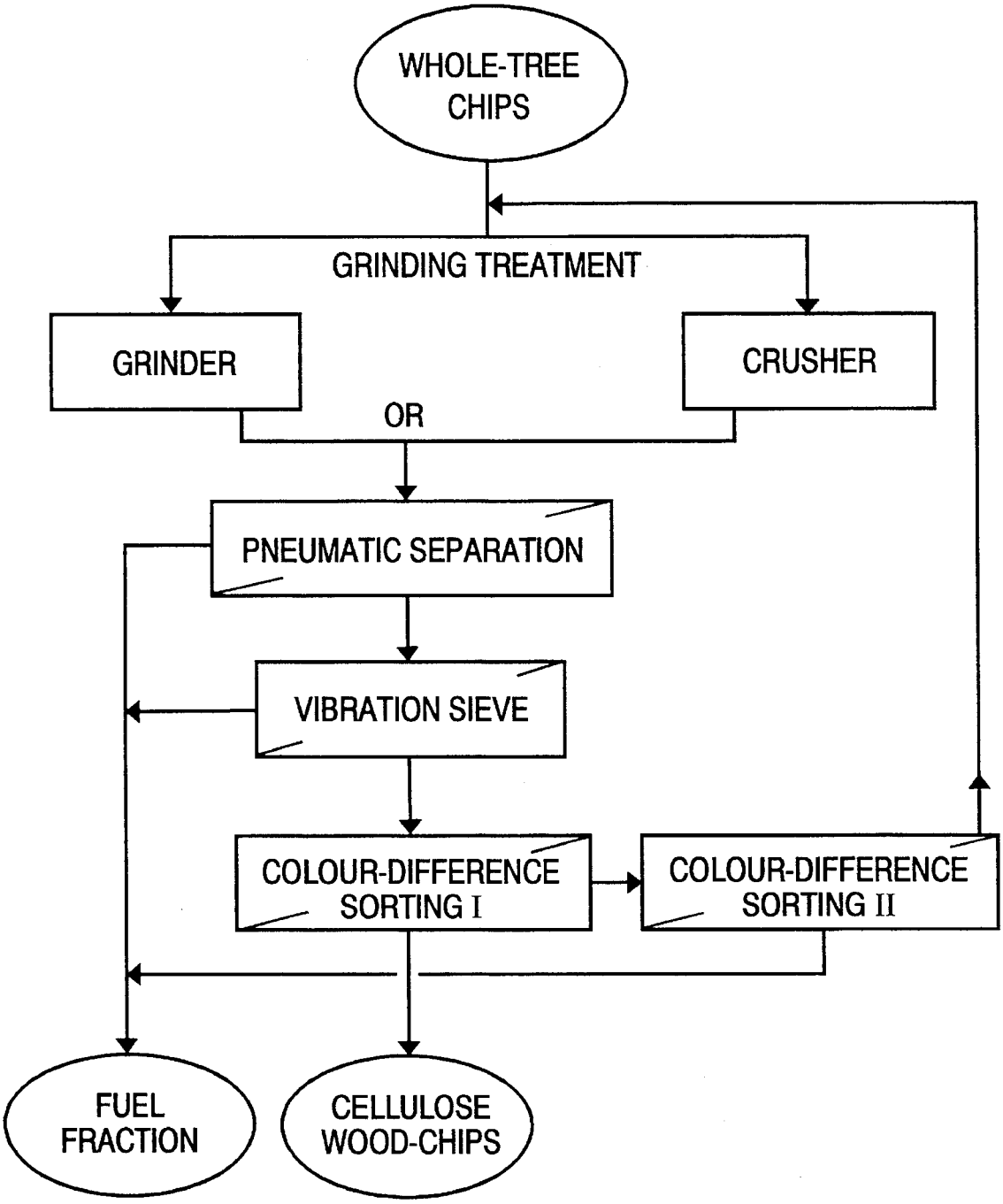
FIG. 1 shows the chip cleaning schematically

There are numerous methods for pre-separation, from which the aforementioned pneumatic separation and vibrator sieve have been selected for FIG. 1. Pneumatic separation can be regarded as being essential, because certain light particles, such as leaves and birch bark, cannot be separated by any other means.

Figure 2:
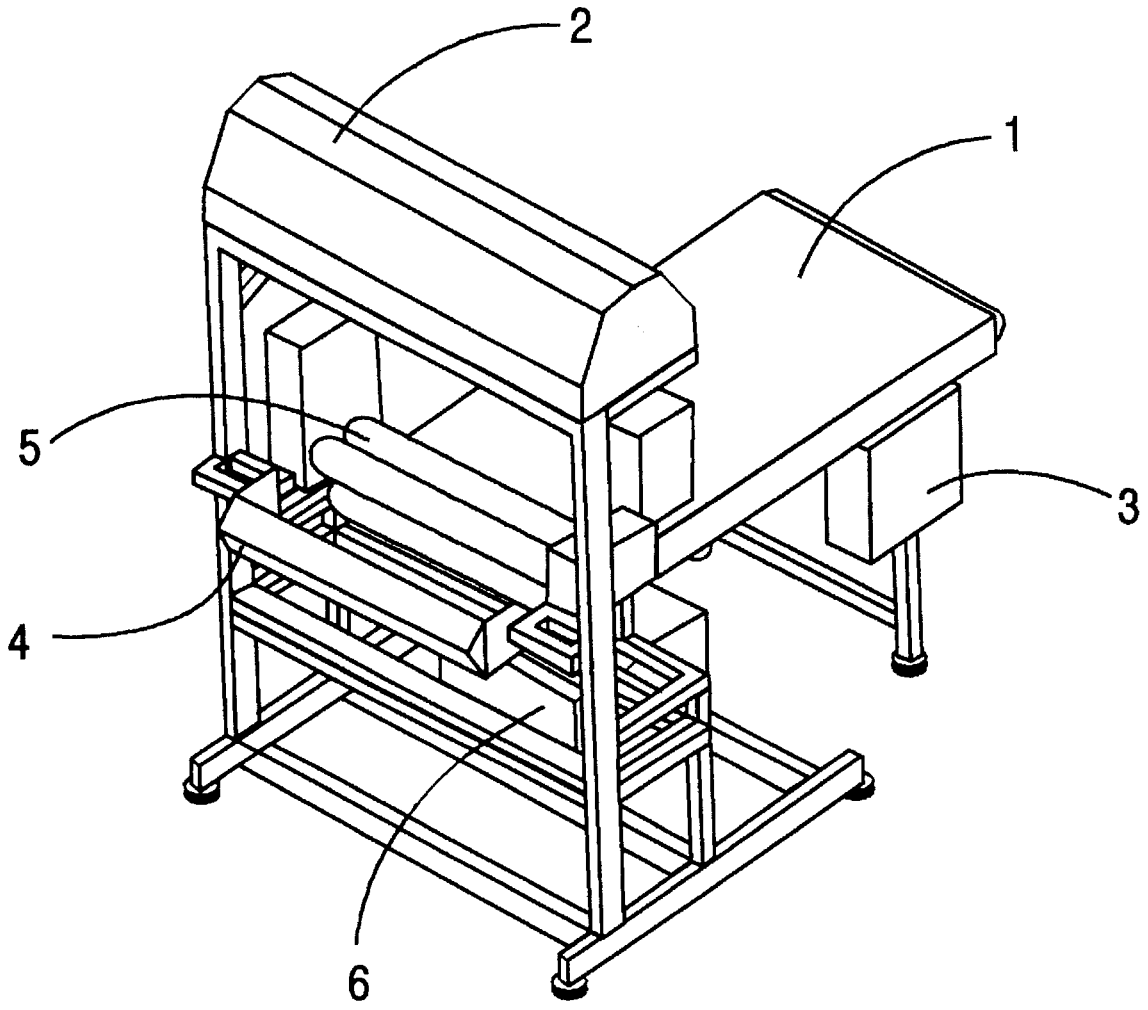
FIG. 2 shows one kind of colour difference sorter

Colour difference separation is carried out by equipment that is in itself of a known type, in which a conveyor belt moves the mass beneath an optical unit that notes the different colour of bark on the belt. The piece of bark is removed from the rest of the mass When it comes to the end of the conveyor, by means of a jet of air. The following describes one known type of colour difference sorter, of the type Sortex 4500. The principal structure of this colour difference sorter is shown in the accompanying FIG. 2. The principal components of the device are a conveyor belt 1, a control unit 2, an optical unit 3, air ejectors 4, a fluorescent light 5, and operating machinery 6. The pre-cleaned wood chip mass is fed to the conveyor belt 1, which moves it at an even speed under optical unit 2. The wood chip mass is illuminated in addition by a fluorescent light 5, in order to achieve a better timing ability. The control unit directs the operating machinery 6, and at a calculated time starts a corresponding air ejector 4, by means of which a bark particle is made to deviate from the direction of the main mass, and in this way the mass is separated into different fractions.

Tests made with a colour difference sorter used wood chips from which pine needle tips, leaves, and fines less than 7 mm had been removed, as had particles thicker than 8 mm and longer than 45 mm. The bark content of the samples of both species of wood was about 5%. In sorting pine a bark content of 0,6% and a yield of 65,5% was achieved with approved particles. With approved birch particles the bark content was 1,9% and the yield 63,8%. In order to improve the yield a second colour difference sorter is used, which removes rejects (share 54,7%) with a high bark content (with pine 24,7%) and the approved fraction is fed back to the grinder. This kind of return is necessary, because often the aforementioned bark content is due to chips with bark, from which the bark must thus first be removed.

When whole-tree wood chips are being used, pre-separation is required to reduce the bark to less than 8% using present methods. The final cleaning of surface plank, i.e. logs with bark, wood chips can on the other hand begin with a bark content of as much as 10%, because the pieces of bark are large.

A thermal image processing system can be used for recognizing and separating the density of chips, when the chip mass flow is first of all heated. The denser pieces, i.e. in practice the knots, then appear at a different temperature to the rest of the mass. Outline recognition is in itself a known technique, but it demands powerful processors and its own program adapted to wood chip mass sorting.

In brief, the significance of the invention can be described as being that by means of which timber raw material is exploited in a more precisely refined form. By means of the invention cellulose chips with a 70% yield can be achieved (bark content 0,5%), whereas known solutions with whole-tree chips achieve at most a yield of 45% with a bark content of 3,0%. The method in accordance with the invention should preferably be compared to present stemwood harvesting, in which using drum grinding the same bark content of 0,5% is naturally achieved, but the yield calculated on the basis of the entire biomass remains at 40%.

Figure 3:
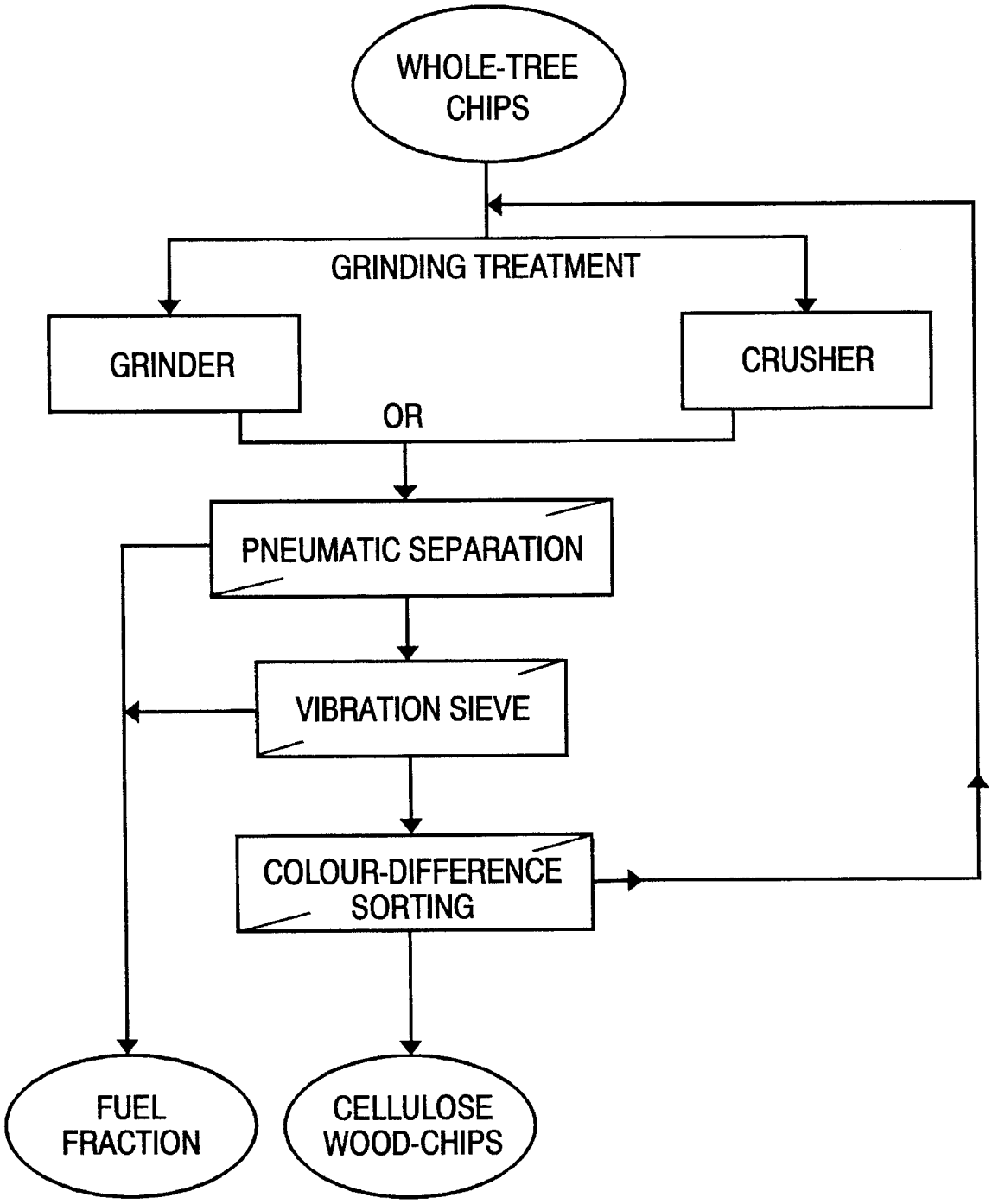
FIG. 3 shows schematically a simplified version of the cleaning equipment

FIG. 3 shows the equipment in FIG. 1 simplified in that in it only one colour difference separator is used, the approved fraction of which is removed from the process as cellulose chips, and the reject, i.e. chips containing bark, is returned to the grinder. As the quality of colour separation is improved and the reject is reduced it can be removed directly as fuel fraction.

I claim:

1. A method for manufacturing predetermined low bark content wood chips and high bark content wood material from whole-tree chips having bark attached, the method comprising:

grinding the whole-true chips to loosen the majority of the bark attached to the chips and simultaneously reduce the particle size of the bark;

mechanically screening and pneumatically separating the ground chips;

the steps of grinding, mechanically screening and pneumatically separating resulting in an intermediate mass flow having a bark content of less than 10%; and then separating the intermediate mass flow by color difference separation so as to separate the low bark content wood chips constituting a first output flow.

2. The method in accordance with claim 1, wherein the color difference separation consists of dividing the intermediate mass flow into a first output flow and an internal flow, and feeding the internal flow back to the grinding step in order to loosen any bark still attached to the chips in the internal flow.

3. The method in accordance with claim 1, wherein the color difference separation consists of:

a first step of separating the intermediate mass flow into the first output flow and a remaining part; and a second stop of separating the remaining part into the high-bark content chips for a second output flow, and an internal flow which is fed back into the grinding step in order to loosen the bark remaining attached to the chips in the internal flow.

4. The method in accordance with claim 3, including adjusting the first step of color difference separation to separate low-bark content chips having a bark content of less than 1%.

5. The method in accordance with claim 2, wherein the step of grinding is performed by a grinder with a gap in the range of 6–14 mm.

6. The method in accordance with claim 5, including initially selecting the thickness of the chip size of the whole-tree chips so that after the step of grinding the share of the chips in the first output flow having a thickness exceeding a selected size in the range substantially 6 to 8 mm is reduced to one-third compared to the corresponding share before the step of grinding.

7. The method in accordance with claim 1, wherein the color separation is based on recognizing at least one of density or shape of the chips.

* * * * *